United States Patent [19]

Scully

[11] Patent Number: 4,597,240

[45] Date of Patent: Jul. 1, 1986

[54] ELECTRIC EYE FOR BAGGING MACHINE

[75] Inventor: John W. Scully, Raynham, Mass.

[73] Assignee: Pneumatic Scale Corporation, Quincy, Mass.

[21] Appl. No.: 742,121

[22] Filed: Jun. 5, 1985

Related U.S. Application Data

[63] Continuation of Ser. No. 431,774, Sep. 30, 1982, abandoned, which is a continuation-in-part of Ser. No. 323,877, Nov. 23, 1981, abandoned.

[51] Int. Cl.[4] ..... B65B 57/12; B65B 57/14; B65B 9/20

[52] U.S. Cl. ..... 53/57; 53/66; 53/552

[58] Field of Search ..... 53/66, 64, 55, 56, 57, 53/58, 73, 74, 551, 552, 554, 451, 504

[56] References Cited

U.S. PATENT DOCUMENTS

| | | | |
|---|---|---|---|
| 2,655,777 | 10/1953 | Hagen | 53/55 X |
| 3,159,955 | 12/1964 | Thurlings | 53/551 |
| 3,295,289 | 1/1967 | Critchell | 53/551 X |
| 3,397,505 | 8/1968 | Critchell | 53/74 |
| 3,983,682 | 10/1976 | Scully | 53/552 X |
| 4,128,985 | 12/1978 | Simmons | 53/64 X |
| 4,288,965 | 9/1981 | James | 53/64 X |

*Primary Examiner*—Horace M. Culver
*Attorney, Agent, or Firm*—Robert T. Gammons

[57] ABSTRACT

Apparatus for forming, filling and sealing bags with a product wherein sheet material is formed into a tube on a hollow mandrel, feed belts are employed to move the tube downwardly on the mandrel and the product is delivered through the mandrel into the tube comprising a sensing device operable to control operation of the feed belts to on the one hand enable the drive for the feed belts when there is product at the discharge end of the mandrel and on the other hand to disable the drive for the feed belts when there is no product at the discharge end.

4 Claims, 6 Drawing Figures

ELECTRIC EYE FOR BAGGING MACHINE

This is a continuation of co-pending application Ser. No. 431,774 filed on Sept. 30, 1982 and now abandoned, which is a continuation-in-part of Ser. No. 323,877, filed Nov. 23, 1981, now abandoned.

BACKGROUND OF INVENTION

Bag forming and filling machines are well known in the art and one of the problems with such machinery has been to so control the bag length that variations in the density of the product will not show up in the form of bags incompletely filled, a condition which is especially irritating to consumers. Premarking the sheet material on which the bags are to be formed with indicia spaced according to the calculated bag length required to hold the product and employing a sensing device, for example, a photoelectric device, to stop and start the feed as determined by the spacing of the indicia as shown, for example, in U.S. Pat. No. 4,077,308 does not solve the problem because this does not take into account the change in density of the product. Manually adjusting the feed from time to time to compensate for the changes in density of the product interrupts operation, requires constant supervision, is time-consuming and is not accurately consistent. It is the purpose of this invention to automatically control bag length according to the level of product in the bag.

SUMMARY OF INVENTION

A bag-forming, filling and cartoning machine comprising, in combination with means for feeding tubular bag forming material downwardly on the external surface of a hollow mandrel, means for at times forming seals transversely of the tubular material, the hollow mandrel providing means for delivering the product into the tube above the seal and means for controlling the feed means for moving the tube downwardly on the mandrel in the form of sensing means operable by the presence of product in the bag at the lower end of the mandrel to enable the means for feeding the tube downwardly on the mandrel and in the absence of product in the bag at the lower end of the mandrel to disable the feeding means. The sensing means as herein employed is a photoelectric device arranged to project a beam which crosses the path along which the tube moves downwardly from the lower end of the mandrel and, preferably, there are slots or openings at or near the lower end of the mandrel through which the beam is projected. There is a motor for driving the feed means through the intermediary of a combination clutch and brake and a control circuit containing the sensing means, the latter through the circuit providing for engaging and disengaging the clutch to on the one hand drive the feed means and on the other hand to stop the feed means. The sheet material of which the tube and ultimately the bags are formed is drawn from a suitable supply onto the mandrel by means of the feed means and there is side seaming means for forming a side seam. The means for forming the transverse seam which ultimately is severed to form the top of a filled bag and the bottom of a bag to be filled comprises jaws and means for closing the jaws on the tube to form the transverse seam and sever the seam and thereafter to open the jaws to allow the filled bags to gravitationally drop through a device which confines them to the cross section of that of the container or carton within which they are to be deposited resting on a conveyor therebelow. Cam-operated means provide for initiating cycling of the filling operation which commences with the jaws closed on the tube at the lower end of the mandrel, dumping a predetermined weighed volume of product into the mandrel while the jaws remain closed, retracting the jaws to open them and initiating operation of the feeding means to move the filled tube downwardly from the lower end of the mandrel. The cycle concludes with reclosing the jaws. The sensing means automatically terminates operation of the feed means independently of the duration of the cycle when the beam detects the absence of product.

The sensing means is contained in a control circuit in which there is a cam-operated starting switch, first and second relays, a normally-open contact and a normally-closed contact so arranged that energization of the first relay closes the normally-open contact and through the normally-closed contact maintains a circuit through the first relay to actuate the feed means and to maintain the feed means in operation until the sensing means in response to the absence of product operates through the second relay means to open the normally-closed contact to thus terminate operation of the feed means. Optionally, there is a second cam-operated switch in the circuit in parallel with the normally-closed contact for bypassing the sensing mean to continue operation of the feed means until a predetermined length of bag has been achieved.

According to the method of this invention as performed by the aforesaid apparatus, tubular material is positioned on the exterior surface of a hollow mandrel with a portion extending beyond the lower end, a seal is formed at the lower end of the mandrel to form the bottom of a bag, product is delivered in a predetermined amount into the tube above the bottom, the tube is moved downwardly to withdraw product from the mandrel and the difference in reflectivity of the portion of the tube containing product and the portion of the tube above the product containing no product moving downwardly from the mandrel is used to terminate downward movement of the tube and form the top of the filled bag and the bottom of the succeeding bag.

The invention will now be described in greater detail with reference to the accompanying drawings, wherein.

Figure 6:
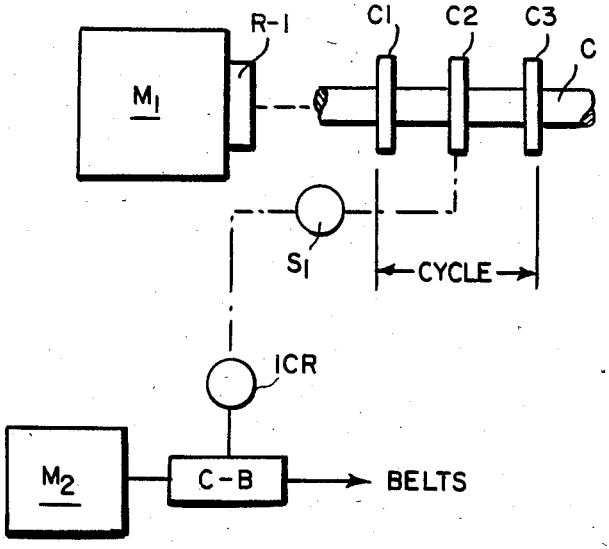

FIG. 6 diagrammatically shows the cam means for cycling the filling operation; and FIG. 7 is a diagram of an alternative control circuit in which, under certain conditions, the photoelectric sensing means can be overridden to insure a preset minimum bag length.

Referring to the drawings, the bag-forming, filling and packaging machine as herein illustrated is of the vertical type as disclosed in U.S. Pat. Nos. 4,077,308 and 3,983,682 incorporated herein by reference. These patents are assigned to the assignee of the instant application. The apparatus and method of this invention, as will appear hereinafter, provide for certain improvements which contribute to expediting filling operations, providing customer-acceptable bagged products and providing economy in the materials, product and time.

The apparatus as herein illustrated comprises a free-standing frame 10 which supports at the top a weighing machine 12 and a funnel 14; at the front side, a hollow mandrel 16 upon which sheet material is formed into a tube, a side-seaming device 18 for forming a seam longitudinally of the tube, feed means 20—20 for moving the formed and side-seamed tube downwardly on the mandrel, means 22 below the lower end of the mandrel for forming seals transversely of the tube and for severing the transversely-sealed tube in the sealed area, means 24 below the sealing and severing means for confining the filled tube to substantially the cross section of the carton or container within which it is to be deposited and a conveyor 26 below the conforming means for moving empty containers or cartons into positions to receive filled bags and move the filled cartons away. There is means on the back side of the frame, not shown, for supporting a supply of sheet material of which the bags are to be formed.

The weighing machine 12 is of conventional construction designed to weigh product and dump it into the hopper 14 at the beginning of each cycle of operation as initiated by a cam shaft to be described hereinafter.

The feeding means 20—20 comprise belts arranged at diametrically-opposite sides of the mandrel 16 with portions paralleling the sides of the mandrel at a proximity thereto such as to frictionally engage the sides of the tube on the external surace of the mandrel and move the tube downwardly on the mandrel. Feed belts 20—20 are driven by a motor, not shown, drivably connected thereby by a combination clutch and brake assembly which provides for declutching the motor from the feed belts to stop the latter and clutching the motor to the feed belt to drive the latter. The clutching is initiated by a cam C2 on the cam shaft C previously referred to above.

Figure 1:
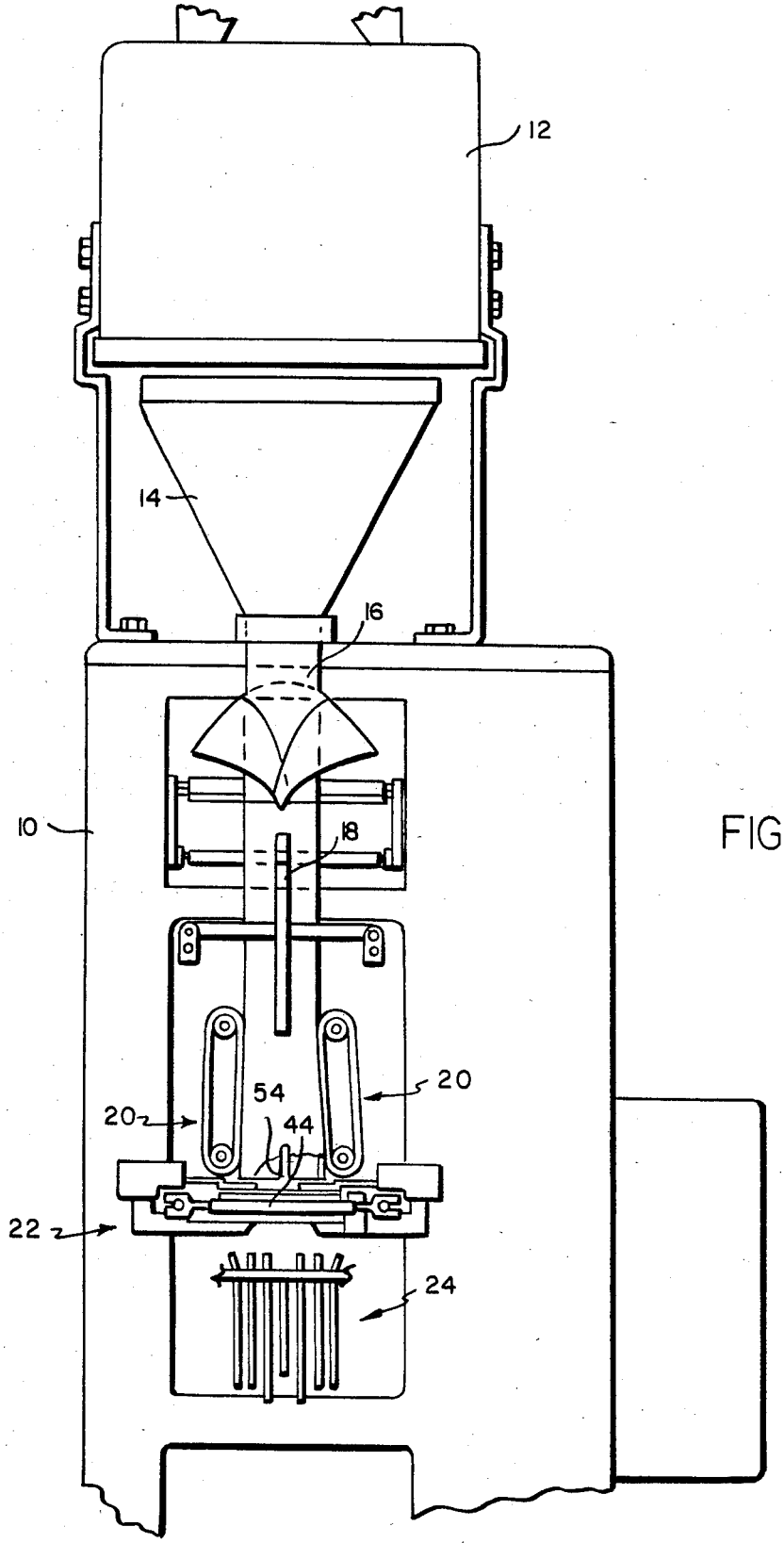
FIG. 1 is a front elevation of the bag-forming and filling machine of this invention showing the upper part, the lower part of the machine being omitted.
Figure 2:
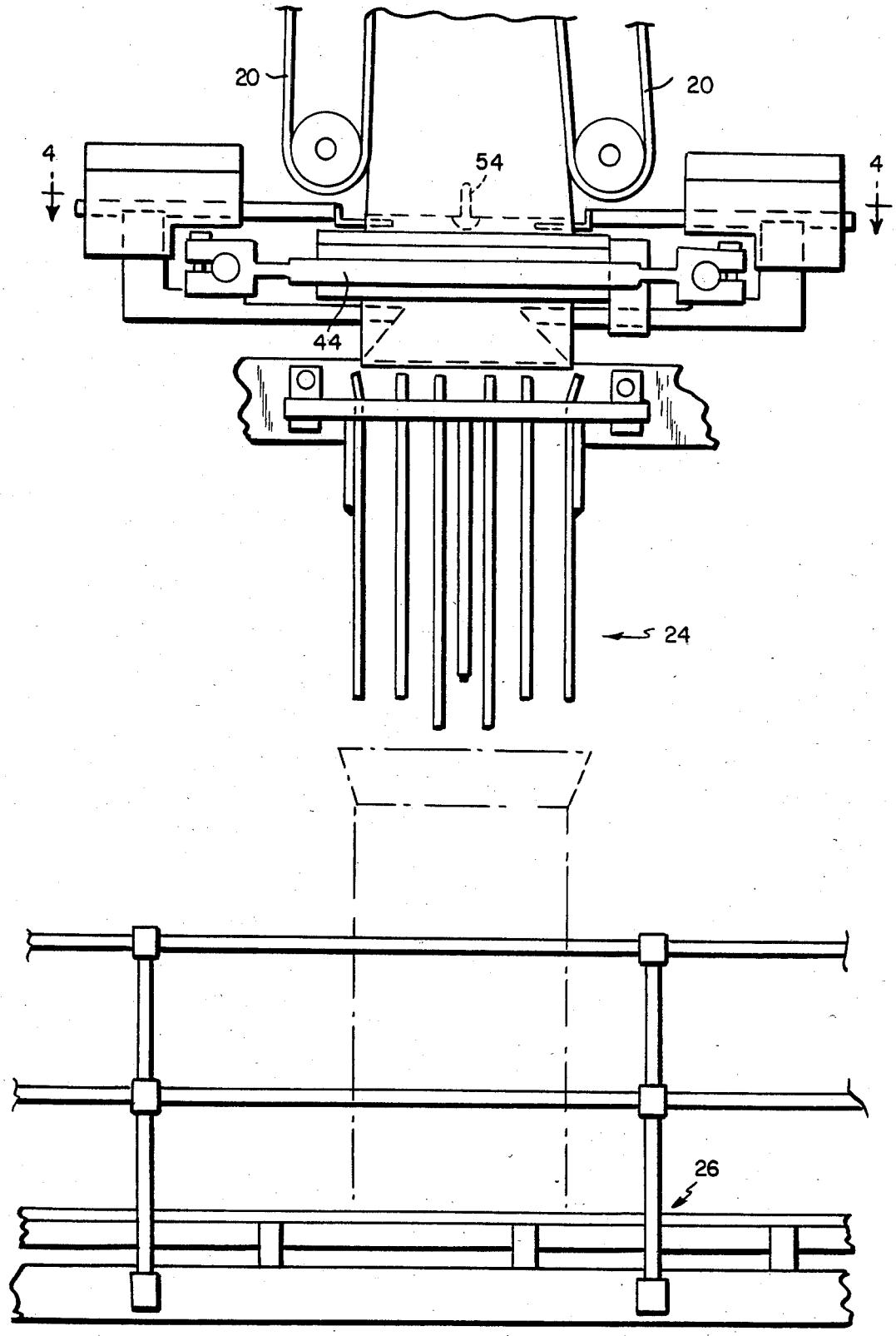
FIG. 2 is an elevation to larger scale of the lower part of the machine shown in FIG. 1, the upper part of the machine being omitted.
Figure 3:
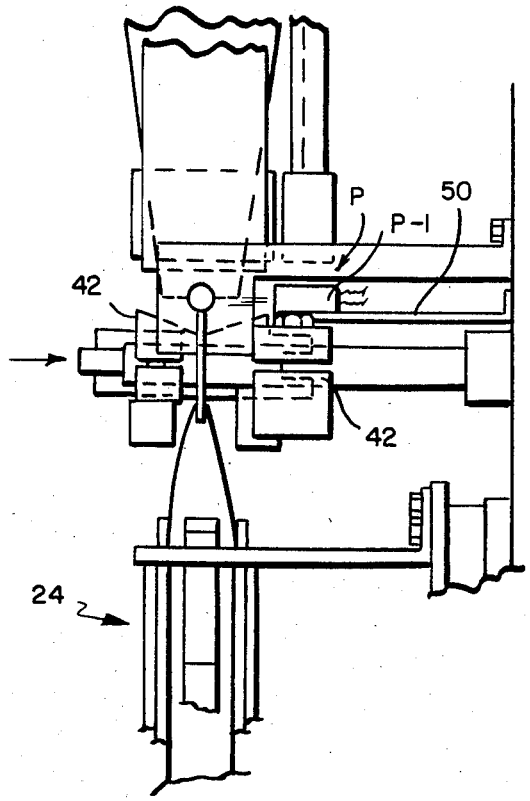
FIG. 3 is a side elevation of that portion of the machine shown in FIGS. 1 and 2 embodying the photoelectric detector of the invention.
Figure 4:
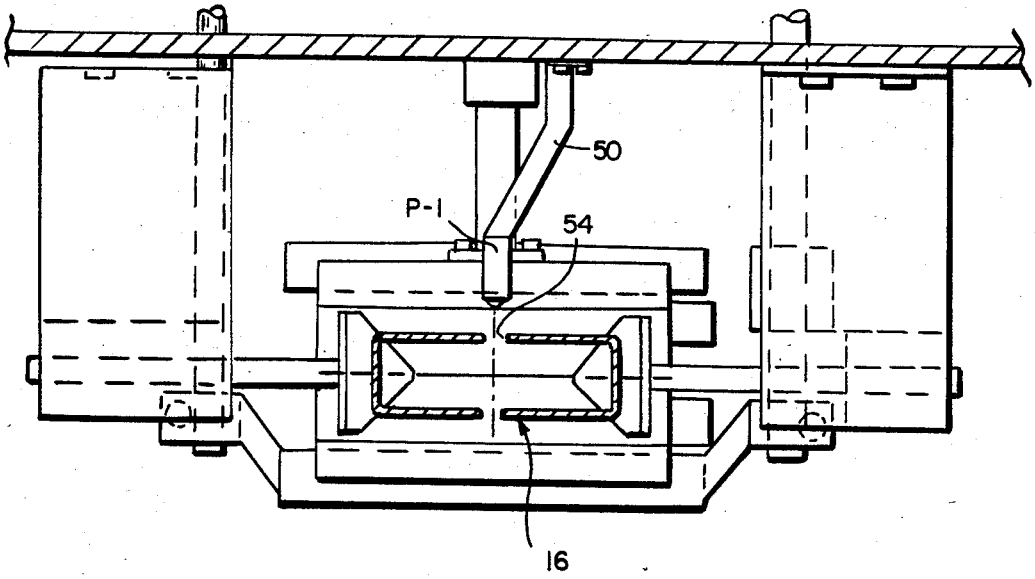
FIG. 4 is a horizontal section taken on the line 4—4 of FIG. 2.

The means 22 for forming the transverse area and severing the tube is in the form of a pair of reciprocally mounted jaws 42—42 FIG.3. There are cams C1 and C3 on the aforesaid cam shaft for initiating a cycle of operation and for opening and closing of the jaws at appropriate times in the cycle of operation.

A conventional cycle of operation comprises dumping a weighed amount of product into the mandrel upon which the tube is formed positioned with its lower end gripped between the closed jaws, retracting or opening the jaws, moving the bag containing the product downwardly on the mandrel and closing the jaws to form a top seal and sever the filled bag from the succeeding bag to be filled. In such a system, the length of bag is dependent upon the length of time the feed is operated during each cycle of operation. In accordance with this invention, the length of operation of the feed means is controlled not by estimation and adjustment or by indicia, but by the amount of product contained in the bag. This is achieved by stopping and starting the feed means as determined by the level of the product in the tube above the bottom seal and to accomplish this, sensing means P FIG. 3 is arranged to detect the presence of the product within the tube as the tube moves downwardly and to stop the tube when the sensing means P no longer detects the presence of the product. As herein illustrated, the sensing means comprises a photoelectric means P-1, FIGS. and 4 supported at the distal end of an arm 50 projecting forwardly from the front of the machine at substantially the lower end of the mandrel. Desirably, the lower end of the mandrel is provided with openings 54—54 midway between its opposite sides so that, in the absence of product, the beam from the photoelectric means pass uninterruptedly through the tube and, when product is present in the tube, the beam is blocked. The photoelectric means P-1 is contained in a control circuit which provides for starting and stopping the feed belts so that when the beam is blocked by the presence of product in the tube, the feed belts are caused to move the tube downwardly on the mandrel and when the beam is uninterrupted, to cause the feed belts to be stopped. The level or height of the product above the bottom seam thus controls the feed for, as the top of the product moves by the beam trained on the tube, the reflectivity of the beam changes due to the absence of product in the tube and this triggers the control circuitry to stop the feed.

Figure 5:
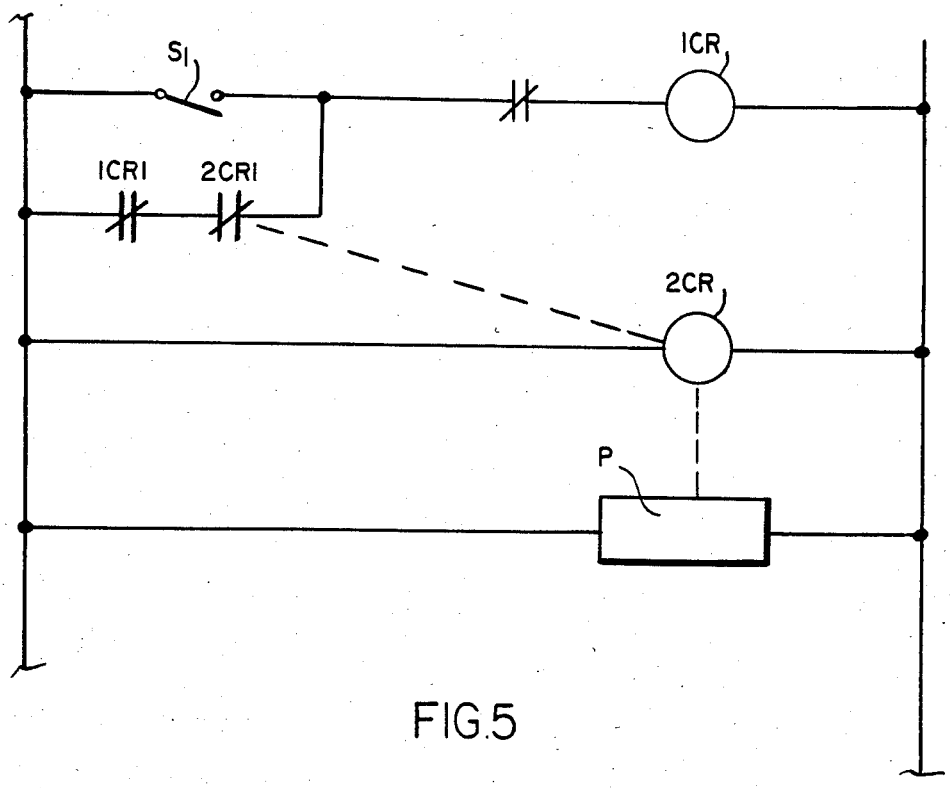
FIG. 5 is a diagram of the control circuit.

The control circuitry for controlling the feed is shown in FIG. 5 wherein a cam C2 on the main cam shaft C closes a switch S1 momentarily, thereby energizing a relay 1CR. Energization of the relay 1CR engages the clutch and disengages the clutch of the combination clutch and brake CB and engages the brake to stop the feed belts. The belts are driven when the clutch is engaged by a motor M2, FIG. 6. Energization of the relay 1CR simultaneously closes contacts 1CR1 so as to hold the relay 1CR energized through normally-closed contacts 2CR1 so as to maintain the circuit through the relay 1CR when the cam C2 passes by the switch S1. Having energized the relay 1CR so that the clutch is engaged, the belts 20—20 will move the tube downwardly on the mandrel until photoelectric means P1 in the circuit cease to see product, whereupon a relay 2CR in the circuit which holds the contacts 2CR1 closed is caused to open the contact 2CR1, thus to break the circuit through the relay 1CR. Deenergization of the relay 1CR deenergizes the clutch and engages the brake to stop the belts and, hence, the feed. When the downward movement of the tube is stopped by the circuitry thus described, the jaws are caused to close, by a cam C3 on the cam shaft, on the tube to form a seal above the product which is wide enough longitudinally of the tube so that, when it is severed, it will provide the top of a filled bag below the jaws and the bottom of a bag to be filled above the jaws. The closing of the jaws completes the cycle by sealing the bag above the product to form the bottom of the next bag to be filled and severing the filled bag so that when the jaws are reopened following the next filling operation, the filled bag will drop gravitationally through the shape retaining means 24 into the carton below. The cycle terminates with reclosing of the jaws and the feed for the next filling cycle is reinitiated by closing of the switch S1. The cam C2 for operating the switch S1 is driven by the cam shaft C which, in turn, is driven by a one revolution clutch R1 from a constantly running motor M.

FIG. 6 diagrammatically shows the cam shaft C driven by a one revolution clutch R1 with cams C1, C2 and C3 which, respectively, initiate a cycle of operation by dumping product from the weighing machine into the mandrel, start the feed means which is thereafter stopped when the predetermined level is sensed by the sensing means, and effects operation of the sealing means to first close the jaws and thereafter to open the jaws.

There are times when the product density is such that the electric eye control produces a bag length which is too short in proportion to the height of the carton, hence, it is desirable to provide means for insuring a preset minimum bag length independent of the sensing means provided for by the photoelectric means P of the circuit shown in FIG. 5. This is achieved herein, FIG. 7, by providing in the control circuit a cam-operated switch S2 in parallel with the relay contact 2CR1 which makes it possible to override the photoelectric control P until the minimum bag length has been achieved. When the cam-operated switch S2 opens, the photosensing means P-1 will reassume control of the feed belts, hence, terminating the bag length by the photoelectric sensing means P-1. This alternative control can be achieved by other techniques such as computer programs or hardware electronics; however, for simplicity, as described above, it is provided for by a simple relay and switch.

The apparatus as herein described depends for its operating on employing wholly or partially transparent or translucent material for the tubular material of which the blocked by or reflected by the presence of product, or is uninterrupted by the absence of product and so passes through the tube. A narrow transparent or translucent area longitudinally of a tubular material which is partially or wholly opaque will serve to actuate the photoelectric sensing means when the latter is so positioned that the beam can see the product through the transparent or translucent area.

From the foregoing, it is apparent that the apparatus controlled by the present of product is independent of manual adjustment which takes time and is not always accurate and eliminates the necessity for having to keep on hand an inventory of premarked bag-forming material.

The apparatus operates cyclically to form, fill and deposit one bag at a time in containers or cartons resting on a conveyor, the latter being driven at a rate to deliver the cartons or containers into position to receive the bags and are released by the retraction of the jaws embodying the sealing and severing means.

It is within the scope of the invention to sever the filled bags below the sealed area, if desired, so that the bags are opened at the top when dropped into the cartons or containers therebelow and to thereafter seal the tops of the bags. The conveyor may be continuously or intermittently driven. If the bags are not be deposited in cartons or containers, they may merely be dropped onto the conveyor.

It should be understood that the present disclosure is for the purpose of illustration only and includes all modifications or improvements which fall within the scope of the appended claims.

What is claimed is:

1. For forming tubular material into a succession of bags filled with material, apparatus comprising means for feeding tubular material along a predetermined vertical path, means located adjacent said path for at times forming a seal transversely of the tube to form the bottom of successive bags, means for delivering a predetermined amount of material to the tube after the seal has been formed and sensing means located in said path operable in the absence of material within the tube as the tube moves relative thereto to disable the feeding means and means for overriding the sensing means to insure a minimum length of tube between seals.

2. For forming tubular material into a succession of bags filled with material, apparatus comprising means for feeding tubular material along a predetermined vertical path, means located adjacent said path for at times forming a seal transversely of the tube to form the bottom of successive bags, means for delivering a predetermined amount of material to the tube after a seal has been formed and sensing means comprising a photoelectric device positioned so that its beam is intercepted by the time presence or material in the tube after a seal has been formed, operable in the absence of material within the tube as the tube relative thereto to disable the feeding means and a cam-operated switch for overriding a photoelectric device to insure an minimum bag length.

3. For forming tubular material into a succession of bags filled with material, apparatus comprising means for feeding tubular material along a predetermined vertical path, means located adjacent said path for at a times forming a seal transversely of the tube to form the bottom of the bag, means for delivering a predetermined amount of material into the tub after the seal has been formed and sensing means located in said path operable in the absence of material within the tube as the tube moves relative thereto to disable the means for feeding the tubular material, means operable thereafter to enable the means for forming the seal to form a seal transversely of the tube above the material and a control circuit containing a cam-operated starting switch, first and second relays, a normally-open contact and a normally-closed contact, so arranged that energization of the first relay closes the normally-open contact and through the normally-closed contact maintains the circuit through the first relay to initiate operation of the means for feeding the tubular material when the cam-operated switch is closed and wherein the sensing means is operable through the second relay to open the normally-closed contact to thereby terminate operation of the means for feeding tubular material.

4. Apparatus according to claim 3 wherein there is a second cam-operated switch in parallel with a normally-closed contact for bypassing the sensing means to continue operation of the means for feeding the tubular material until a predetermined length has been achieved.

* * * * *

UNITED STATES PATENT AND TRADEMARK OFFICE

CERTIFICATE OF CORRECTION

PATENT NO. : 4,597,240

DATED : July 1, 1986

INVENTOR(S) : John W. Scully

It is certified that error appears in the above-identified patent and that said Letters Patent are hereby corrected as shown below:

Claim 2, column 6, line 22, delete "time"

change "or" to --of-- line 24, after "tube" insert --moves--

Signed and Sealed this

*Sixteenth* Day of *September 1986*

[SEAL]

*Attest:*

DONALD J. QUIGG

*Attesting Officer*

*Commissioner of Patents and Trademarks*